US008834050B2

(12) United States Patent
Liba

(10) Patent No.: US 8,834,050 B2
(45) Date of Patent: Sep. 16, 2014

(54) SYSTEM FOR DOCKING AND UNDOCKING PACKAGES FOR COSMETICS, AND SET OF PACKAGES FOR COSMETICS

(75) Inventor: Anderson Alan Liba, Junaiai (BR)

(73) Assignee: Natura Cosméticos S.A., Itapecerica da Serra SP (BR)

( * ) Notice: Subject to any disclaimer, the term of this patent is extended or adjusted under 35 U.S.C. 154(b) by 436 days.

(21) Appl. No.: 13/377,671

(22) PCT Filed: Jun. 28, 2010

(86) PCT No.: PCT/BR2010/000201

§ 371 (c)(1),
(2), (4) Date: Feb. 17, 2012

(87) PCT Pub. No.: WO2010/148468

PCT Pub. Date: Dec. 29, 2010

(65) Prior Publication Data

US 2013/0089367 A1 Apr. 11, 2013

(30) Foreign Application Priority Data

Jun. 26, 2009 (FR) ..... 09 54374

(51) Int. Cl.

| | |
|---|---|
| ***A45D 40/24*** | (2006.01) |
| ***A45D 40/18*** | (2006.01) |
| ***A45D 40/26*** | (2006.01) |
| ***B65D 21/02*** | (2006.01) |
| ***A45D 34/06*** | (2006.01) |

(52) U.S. Cl.

CPC ..... *A45D 40/26* (2013.01); *A45D 40/18* (2013.01); *B65D 21/0217* (2013.01); *A45D 40/24* (2013.01); *A45D 40/265* (2013.01); *A45D 40/267* (2013.01); *A45D 34/06* (2013.01)

USPC ..... 401/18; 401/17; 401/124; 401/129

(58) Field of Classification Search

CPC ..... A45D 40/24

USPC ..... 401/17, 18

See application file for complete search history.

(56) References Cited

U.S. PATENT DOCUMENTS 6,276,853 B1 8/2001 Briedenbach et al.
6,464,418 B1 10/2002 Visser et al.

(Continued)

FOREIGN PATENT DOCUMENTS

FR 2 847 131 5/2004

OTHER PUBLICATIONS

International Search Report dated Aug. 13, 2010, in corresponding Application No. PCT/BR2010/000201.

(Continued)

*Primary Examiner* — David Walczak
*Assistant Examiner* — Joshua Wiljanen
(74) *Attorney, Agent, or Firm* — Alston & Bird LLP

(57) ABSTRACT

The present invention refers to a system for docking and undocking packages for cosmetics, capable of offering a simplified and efficient fitting and detaching mechanism for the packages The system comprises a first package and a second package for cosmetics, the first and second packages being respectively comprised by a first and second bottle, the first and second bottles being respectively associated with a first cap and a second cap, the first package for cosmetics being docked to the second package for cosmetics upon a compression movement, and concomitantly, upon the cooperation between a first cap projection and a second cap projection respectively arranged on the first and second caps, the first package for cosmetics being undocked from the second package for cosmetics upon a traction movement substantially contrary to the compression movement, the first cap projection having a geometry which is identical to the second cap projection.

13 Claims, 2 Drawing Sheets

(56) References Cited

U.S. PATENT DOCUMENTS

| | | | | |
|---|---|---|---|---|
| 6,682,242 | B1 | 1/2004 | Montoli | |
| 6,702,494 | B2 * | 3/2004 | Dumler et al. | 401/17 |
| 8,434,955 | B2 * | 5/2013 | Rauschert et al. | 401/18 |
| 2008/0067170 | A1 * | 3/2008 | Ponton et al. | 220/255 |
| 2011/0020046 | A1 * | 1/2011 | Dumler et al. | 401/17 |

OTHER PUBLICATIONS

Written Opinion of the International Searching Authority dated Aug. 13, 2010, in corresponding Application No. PCT/BR2010/000201.

French Industrial Design Registration No. 000906458 issued Apr. 22, 2008.

* cited by examiner

SYSTEM FOR DOCKING AND UNDOCKING PACKAGES FOR COSMETICS, AND SET OF PACKAGES FOR COSMETICS

CROSS REFERENCE TO RELATED APPLICATIONS

This application is a national stage application, filed under 35 U.S.C. §371, of International Application No. PCT/BR2010/000201, filed Jun. 28, 2010, which claims priority to French Application No. 09 54374, filed Jun. 26, 2009, both which are hereby incorporated by reference in their entirety.

BACKGROUND

1. Related Field

The present invention refers to a system for docking and undocking packages for cosmetics, capable of offering a simplified and efficient fitting and detaching mechanism for said packages, apart from providing users with versatility regarding the assembly of several kits of products for makeup.

Additionally, the present invention refers to a set of packages for cosmetics provided with a system for docking and undocking as proposed in the object claimed herein.

2. Description of Related Art

Currently, it is possible to realize a growing demand for packages and the like, for daily use, which enable easy handling or also versatility regarding the types of materials which can be stored in such packages.

More particularly, it is verified that in the field of packages for cosmetics, consumers are more interested in those showing a more attractive design, as well as in those which are more practical in the way they are handled.

Many times, the size and the shape of such packages shall make the final products easier to be used by consumers, so that they can be stored in several places, either at the domestic environment or at the workplace.

However, the solutions found in the state of the art still lack more flexibility regarding the use of more than one cosmetic product in fitting packages, in a way that it is possible to carry only the package that still contains the product.

North-American patent U.S. Pat. No. 6,464,418 refers to a dockable storage container aimed at storing solid products, such as powders or also liquid products.

Document U.S. Pat. No. 6,464,418 also discloses a container comprising a unisex docking mechanism to be docked to different containers.

Anyhow, said North-American document does not provide an efficient and simplified docking system, as proposed by the present invention, upon the assembly of cap projections which can docked and easily removed by users.

Prior art U.S. Pat. No. 6,276,853 refers to a liquid container for the distribution of liquids such as perfumes or other fragrances, including one cap of two edges compatible with a plurality of bottles.

However, document U.S. Pat. No. 6,276,853 does not disclose an efficient and simple system for docking and undocking of packages for cosmetics, as the one proposed by the invention herein, once a mechanism for fitting and detaching provided on the cap portions of said packages was not disclosed.

The industrial design OHIM 000906458-0002 refers to a cap which can be docked to another cap by connectors. Said caps may have applying elements; however, such caps do not provide, as disclosed by their figures, an efficient docking system for packages, guided by cap portions, in order make the handling of such packages easier to end users.

Further, another prior art related to this invention, is disclosed in FR 2 847 131. According this prior art, two identical parts are associated to each other. Although this invention provides a solution in which two identical parts are used, the configuration of the connections parts not only is difficult to be manufactured through complicated molding process, but also provides an unfavorable docking movement, as the user will have difficulties to align the parts, and also to make the correct connection of the parts.

Still another prior art, is disclosed in U.S. Pat. No. 6,682,242. This prior art also discloses a solution in which two identical parts are associated to each other. However, according to this solution, a number of curves and fitting elements have to be designed and carefully molded, especially considering the fact that the snap fitting proposed in this prior art is embodied by a fixation in two different planes, if a cross-section of the package is taken, thus, the docking movement is complicated to be done by an average user and especially, the molding process has to be very accurate, thus laborious an expensive to be concluded.

Based on the foregoing, it is possible to realize that the solutions currently available in the state of the art do not provide end users with a system for docking and undocking of packages for cosmetics which is more versatile and efficient, as regards the storage and handling of said packages, as proposed in the object claimed herein.

The purpose of the present invention is to propose a system for docking and undocking packages for cosmetics, capable of offering a simplified and efficient fitting and detaching mechanism for said packages, and to provide users with versatility regarding the assembly of several kits of products for makeup.

An additional purpose of the present invention refers to a set of packages for cosmetics provided with a system for docking and undocking as proposed in the object claimed herein.

BRIEF SUMMARY

The purpose of the present invention is achieved by providing a system comprised by a first package for cosmetics, a second package for cosmetics, the first and the second packages for cosmetics being respectively comprised by a first and second bottle, the first and second bottles being able to be respectively associated with a first and a second cap, system in which the first package for cosmetics being docked to the second package for cosmetics upon a compression movement, and concomitantly, upon the cooperation between a first cap projection and a second cap projection respectively arranged on the first and second caps, the first package for cosmetic being undocked from the second package for cosmetics upon a traction movement substantially contrary to the compression movement, the first cap projection having a geometry identical to the second cap projection, the cooperation between the first cap projection and the second cap projection occurring by means of a first joining element and a second joining element respectively arranged on at least one surface of the first and second cap projections, said cooperation being done in a single plane in the direction of the compression movement.

The second purpose of the present invention is achieved by providing a set of packages for cosmetics, comprising a first package for cosmetics, a second package for cosmetics, the first and second packages for cosmetics being respectively comprised by a first and second bottle, the first and second bottles being able to be respectively associated with a first and a second cap, set of packages for cosmetics in which the first package for cosmetics being docked to the second package for cosmetics upon a compression movement, the first package of cosmetics being undocked from the second package for cosmetics upon a traction movement substantially contrary to the compression movement, the first package for cosmetic being docked to the second package for cosmetics upon the cooperation between a first cap projection and a second cap projection respectively arranged on the first and second cap, said cooperation being done in a single plane in the direction of the compression movement.

BRIEF DESCRIPTION OF THE FIGURES

The present invention will be described next in more details, with reference to the attached drawings, in which.

DETAILED DESCRIPTION OF VARIOUS EMBODIMENTS

As previously mentioned, the object of the invention proposed herein offers to end consumers a system for docking and undocking packages for cosmetics, showing more versatility and efficiency, as regards the storage and handling of such packages for makeup.

Figure 1:
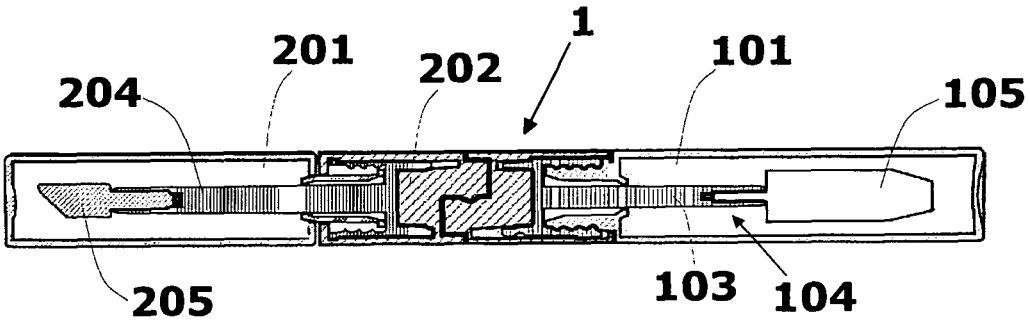
FIG. 1—represents a sectional view of the docking of packages for cosmetics, object of the present invention.

FIG. 1 shows a sectional view of the docked packages, according to the teachings of the present invention.

More particularly, it is known that the system for docking and undocking packages for cosmetics 1 proposed herein comprises a first package for cosmetics 100 and a second package for cosmetics 200. Each package has a substantially cylindrical shape; however, other shapes may also be employed.

The first and second packages for cosmetics 100,200 are respectively comprised by a first and second bottle 101, 201, which can be both respectively associated with a first 102 and second cap 202.

As already mentioned, the innovative feature of the present invention, in view of the prior arts, is the fact that the first package for cosmetics 100 is docked to the second package for cosmetics 200, upon a compression movement 11, and concomitantly, upon the cooperation between a first cap projection 51 and a second cap projection 52, respectively arranged on the first and second caps 102,202.

Such arrangement allows end users or consumers to easily fit such packages, in addition to a safety connection for both parts.

Figure 2:
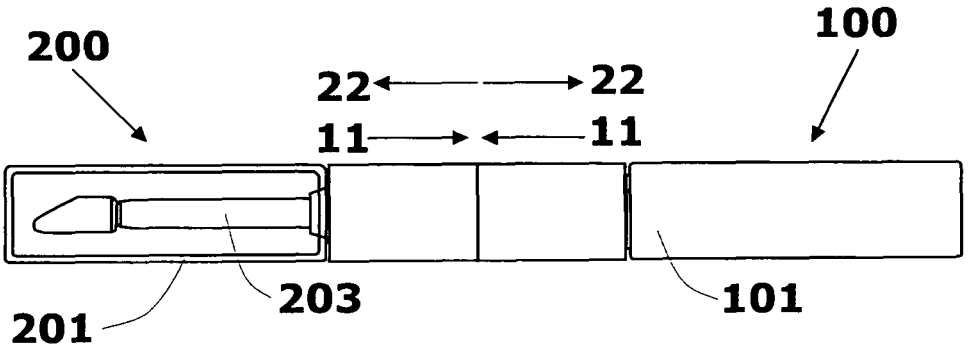
FIG. 2—represents an upper view of the docking of packages for cosmetics, object of the present invention.

FIG. 2 shows such associated packages in a configuration which is typical for a single part.

Figure 3:
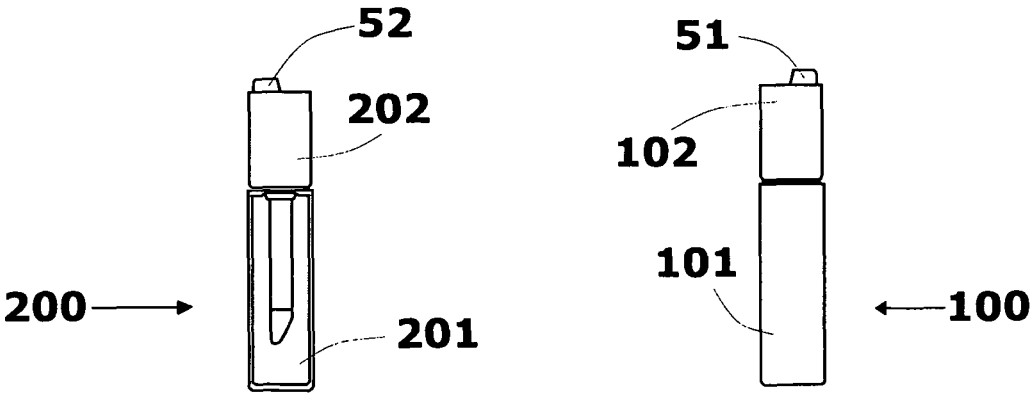
FIG. 3—represents a side view of each one of the packages, object of the present system for docking and undocking.
Figure 4:
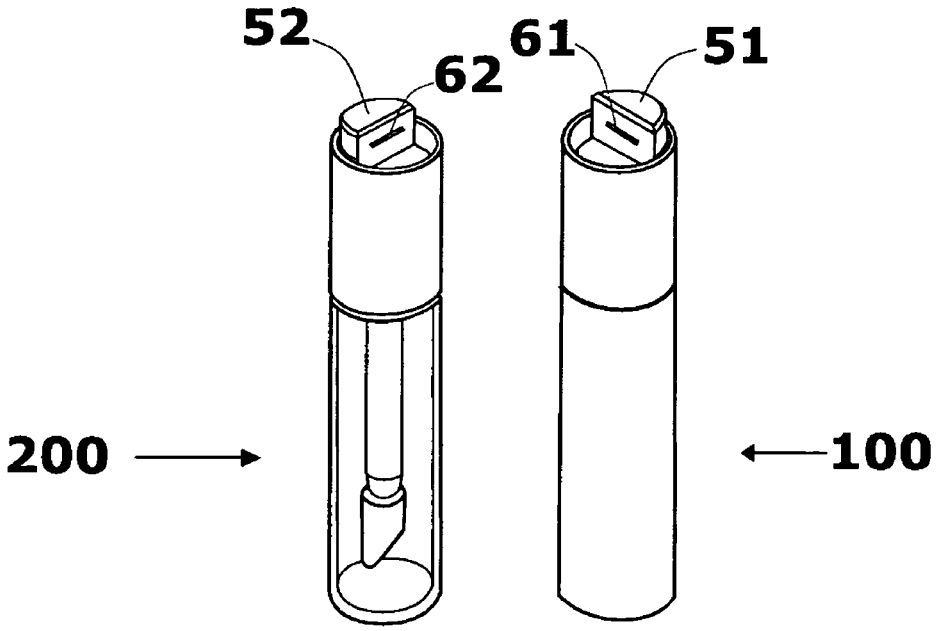
FIG. 4—represents a perspective view of each one of the packages, object of the present invention.

Additionally, FIGS. 3 and 4 show that the first cap projection 51 is arranged in parallel and in a mirrored way in relation to the second cap projection 52. When the first package for cosmetics 100 is assembled with the second package for cosmetics 200, the first cap projection 51 and the second cap projection 52 remain arranged in parallel.

In this sense, the first package for cosmetics 100 is undocked, or disassociated, from the second package for cosmetics 200 upon a traction movement 22 substantially contrary to the compression movement 11. It is also important to highlight that the first cap projection 51, as illustrated in FIG. 4, has an identical geometry to the second cap projection 52.

According to the teachings of the present invention, the compression movement 11 and the traction movement 22 are preferably applied within the range from 2 to 9 Kgf.

FIG. 1 also shows that the first and second caps 102, 202 are respectively associated with a first and second applying element 103, 203.

FIG. 4 illustrates in more details, from a perspective view, an important feature of each one of the packages, object of the present invention.

It is possible to note the existence of a projection on the cap of each one of the packages which contributes to the docking of said packages in a more efficient and agile manner, when compared with the state of the art solutions.

Figure 5:
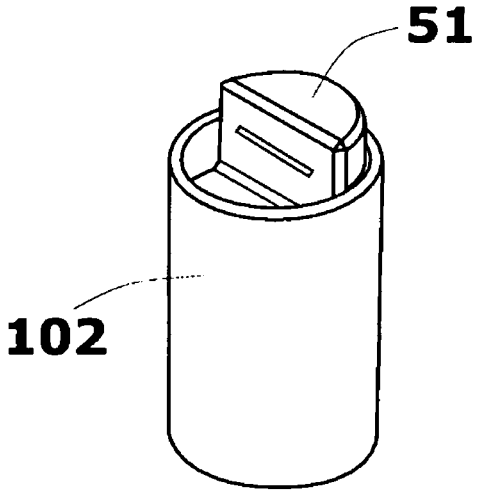
FIG. 5—represents a perspective view of one of the caps for packages, according to the teachings of the present invention.

More especially, the present invention provides cooperation between the first cap projection 51 and the second cap projection 52, in a way that such cooperation occurs by means of a first joining segment 61 and a second joining segment 62 respectively arranged on at least one surface of the first 51 and second 52 cap projections. FIG. 5 shows an additional view of the joining segment present in each one of the caps, object of the present invention. As can be seen, the surface of the first and second cap projections 51,52, are arranged to be placed parallely to each other, when the first package for cosmetics 100 is undocked/docketed from/to the second package for cosmetics 200. The first joining segment 61 and a second joining segment 62 are arranged in such manner, that one single fitting is necessary. In being arranged in that manner, the first and second join to each other providing a significantly less complicated assembling process as the mold to form the parts will not only form a single part—useable simultaneously for the first and second package for cosmetics 100, 200—, but also, will have less problem as to the necessary tolerance to manufacture the product as there is no need to have an exact fitting, such as it is necessary in a snap fitting according to the prior art solutions. Moreover, the fixation between the first and second cap projections 51,52, is done at a single plane, if a cross-section of the package is taken. This does provide a an easier docking an undocking movement, while still preserving a precise fixation between parts.

Additionally, it is verified that the first 103 and second 203 applying elements respectively comprise a first shaft 104 and a second shaft 204. Such first 104 and second 204 shafts can be respectively associated with the first 105 and second 205 applying brushes.

To disassemble the first 104 and second 204 shafts from the first 105 and second 205 applying brushes, it is necessary to apply a second traction movement 23 to the packages. Such traction movement 23 is preferably applied at the range of 0.5 Kgf.

Preferably, and as illustrated in FIG. 4, the first cap 102 and the second cap 202 have substantially circular shapes; however, other shapes may be used according to the teachings of the present invention.

Similarly, the first cap projection 51 and the second cap projection 52 are preferably comprised by a cross-sectional portion which is substantially semicircular. In this case, other equivalent shapes may also be employed for said cap projections.

One important feature of the present invention refers to the fact that the first cap 102 and the second cap 202 are made of the same material of the first cap projection 51 and the second cap projection 52.

Finally, a set of packages for cosmetics is covered by the present invention, said package comprising a first package for cosmetics 100, a second package for cosmetics 200.

The first 100 and second 200 packages for cosmetics respectively comprise a first 101 and second 201 bottle. Such first 101 and second 201 bottles can be respectively associated with a first cap 102 and a second cap 202.

The first package for cosmetics 100 is preferably docked, and similarly to the way previously described, to the second package for cosmetics 200 upon a compression movement 11.

The first package for cosmetics 100 is undocked from the second package for cosmetics 200 upon a traction movement 22 substantially contrary to the compression movement 11, the first package for cosmetics 100 being docked to the second package for cosmetics 200 upon the cooperation between a first cap projection 51 and a second cap projection 52 respectively arranged on the first cap 102 and the second cap 202.

In other words, it is possible to state that the first cap 102 and the second cap 202 have substantially circular shapes, each one of said caps comprising a flange. Furthermore, the first cap projection 51 and the second cap projection 52 have substantially semicircular shapes and are projected from the flange mentioned. FIG. 4 illustrates such feature of the package object of the present invention.

The set of packages claimed herein is characterized by the fact that the compression movement 11 and the traction movement 22 are preferably within the range from 2 to 9 Kgf.

Some preferred embodiments having been described, it should be understood that the scope of the present invention embraces other possible variations, being limited only by the contents of the attached claims, which include the possible equivalents.

The invention claimed is:

1. System for docking and undocking packages for cosmetics (1), the system comprising:

a first package for cosmetics (100);

a second package for cosmetics (200);

the first and second packages for cosmetics (100,200) respectively comprised by a first and second bottle (101, 201);

the first and second bottles (101,201) being able to be respectively associated with a first cap (102) and a second cap (202), wherein:

the first package for cosmetics (100) is docked to the second package for cosmetics (200) upon a compression movement (11), and concomitantly, upon the cooperation between a first cap projection (51) and a second cap projection (52) respectively arranged on the first and second caps (102,202), the first package for cosmetics (100) being undocked from the second package for cosmetics (200) upon a traction movement (22) substantially contrary to the compression movement (11), the first cap projection (51) having a geometry identical to the second cap projection (52); and the cooperation between the first cap projection (51) and the second cap projection (52) occurs via a first joining element (61) and a second joining element (62) respectively arranged on at least one surface of the first and second cap projections (51,52), said cooperation being done in a single plane in the direction of the compression movement.

2. System for docking and undocking packages for cosmetics (1), according to claim 1, wherein the compression movement (11) and the traction movement (22) are within the range from 2 to 9 Kgf.

3. System for docking and undocking packages for cosmetics (1), according to claim 1, wherein the first and second caps (102,202) are respectively associated with a first and second applying element (103,203).

4. System for docking and undocking packages for cosmetics (1), according to claim 3, wherein the first and second applying elements (103,203) are respectively comprised by a first and second shaft (104,204).

5. System for docking and undocking packages for cosmetics (1), according to claim 4, wherein the first and second shafts (104,204) can be respectively associated with the first and second applying brushes (105,205).

6. System for docking and undocking packages for cosmetics (1), according to claim 5, wherein the first and second shafts (104,204) can be disassociated from the first and second applying brushes (105,205) upon a second traction movement (23) of approximately 0.5 Kgf.

7. System for docking and undocking packages for cosmetics (1), according to claim 1, wherein the first and second cap projections (51,52) are substantially arranged in parallel on the docking of the first 15 and second packages for cosmetics (100,200).

8. System for docking and undocking packages for cosmetics (1), according to claim 1, wherein the first and second caps (102,202) have substantially circular shapes.

9. System for docking and undocking packages for cosmetics (1), according to claim 1, wherein the first and second cap projections (51,52) comprise a cross-sectional portion which is substantially semicircular.

10. System for docking and undocking packages for cosmetics (1), according to claim 1, wherein the first and second caps (102,202) are made of the same material as the first and second cap projections (51,52).

11. Set of packages for cosmetics (1), said set comprising:

a first package for cosmetics (100);

a second package for cosmetics (200);

the first and second packages for cosmetics (100,200) being respectively comprised by a first and second bottle (101,201);

the first and second bottles (101,201) being able to be respectively associated with a first and a second cap (102,202), wherein:

the first package for cosmetics (100) is docked to the second package for cosmetics (200) upon a compression movement (11), the first package for cosmetics (100) being undocked from the second package for cosmetics (200) upon a traction movement (22) substantially contrary to the compression movement (11), the first package for cosmetics (100) being docked to the second package for cosmetics (200); and the cooperation between a first cap projection (51) and a second cap projection (52) respectively arranged on the first and second caps (102,202), said cooperation being done in a single plane in the direction of the compression movement.

12. Set of packages for cosmetics (1), according to claim 11, wherein the first and second caps (102,202) have substantially circular shapes, the first and second caps (102,202) being comprised by a flange, the first and second cap projections (51,52) having substantially semicircular shapes and being projected from said flange.

13. Set of packages for cosmetics (1), according to claim 11, wherein the compression movement (11) and the traction 20 movement (22) are within the range from 2 to 9 Kgf.

* * * * *